US006913246B1

(12) United States Patent
Skach

(10) Patent No.: US 6,913,246 B1
(45) Date of Patent: Jul. 5, 2005

(54) UNIVERSAL PRY BAR

(76) Inventor: Joseph R. Skach, 10260 SW. Hoodview Dr., Tigard, OR (US) 97224

( * ) Notice: Subject to any disclaimer, the term of this patent is extended or adjusted under 35 U.S.C. 154(b) by 32 days.

(21) Appl. No.: 10/777,278

(22) Filed: Feb. 11, 2004

(51) Int. Cl.[7] ..... B66F 15/00
(52) U.S. Cl. ..... 254/25; 254/21; 254/131
(58) Field of Search ..... 254/25, 21, 18, 254/131, 131.5; 7/166; 82/45, 46; 30/169

(56) References Cited

U.S. PATENT DOCUMENTS

| | | | | |
|---|---|---|---|---|
| 888,841 | A | 5/1908 | Naudain | |
| 900,338 | A | 10/1908 | Wolfe | |
| 1,317,156 | A | 9/1919 | Diamond | |
| 1,329,458 | A | 2/1920 | Cobb | |
| 1,410,801 | A | 3/1922 | Erickson | |
| 3,288,437 | A | 11/1966 | Pederson | |
| 5,749,113 | A | 5/1998 | Witter | |
| 5,938,177 | A | 8/1999 | Fonda | |
| D431,990 | S | 10/2000 | Hyslop et al. | |
| 6,186,479 | B1 | 2/2001 | Witter | |
| 6,505,817 | B1 * | 1/2003 | Witter | 254/25 |
| 6,715,734 | B1 * | 4/2004 | Wise | 254/25 |
| 2004/0069978 | A1 * | 4/2004 | Whelan | 254/25 |

* cited by examiner

*Primary Examiner*—Lee D. Wilson
(74) *Attorney, Agent, or Firm*—Schwabe, Williamson & Wyatt, P.C.

(57) ABSTRACT

A pry bar tool having independent components, including a fulcrum, multiple and different handles, and multiple bar ends, said handles and bar ends selectively and releasably attachable to the fulcrum to accommodate different pry bar tasks.

10 Claims, 2 Drawing Sheets

UNIVERSAL PRY BAR

FIELD OF THE INVENTION

This invention relates to a tool commonly used in construction and/or demolition, generically referred to as a pry bar, and more particularly it relates to an assembly of components that can be interchangeably assembled to customize the tool to a variety of tasks.

BACKGROUND OF INVENTION

A pry bar in accordance with the present invention includes a bar end portion, a fulcrum portion and a handle portion. The bar end portion typically (but not necessarily) has a flat leading edge that can be inserted under a member secured to a support, e.g. a to-be-removed floorboard fastened to an under-flooring. A heel or fulcrum portion is located rearward of the leading edge and a handle portion extends rearwardly and upwardly from the heel or fulcrum portion. The tool user forces the flat leading edge under, e.g. the floorboard and forces pivotal movement of the handle about the fulcrum to raise the leading edge. Typically, a first pry motion as described produces partial raising of the board edge to permit the user to further insert the leading edge and further raise the board. A user becomes proficient in the procedure and with a couple of repeats (insert and pry) will accomplish the task of detaching the board from the under-flooring.

The above explanation is one of many tasks suitable for the pry bar and the tasks range from a delicate removal task to a task demanding substantial brute force. To accommodate these tasks in the past, either the user carried a number of pry bars or made due with a pry bar of mid-range size.

BRIEF DESCRIPTIONS OF THE INVENTION

It is an objective of the present invention to provide an assembly of tool components that can be discriminately assembled together to selectively construct any of a variety of different pry bars to accommodate a variety of pry bar tasks.

In a preferred embodiment, the three individual components are the handle, the fulcrum and the bar end. The fulcrum may be a single item of, e.g. a half-moon configuration. The rounded bottom provides the abutment surface and the flat top is configured to receive a bar end. The bar end has a flat, straight body portion that engages a substantial length of the flat top and is secured to the flat top with multiple screws seated in threaded holes in the flat surface. The bar end protrudes beyond one end of the fulcrum with the protruded end shaped to provide e.g. a tapered/flared end tip for insertion under a member to be pried. In an alternate embodiment the threaded holes are extended along the flat top and the bar end can be adjusted to protrude different lengths beyond the end of the fulcrum.

At the end of the fulcrum opposite the bar end, an enlarged threaded opening is provided, the axis of which is angled relative to the flat top. The enlarged threaded opening removably receives e.g. a cylindrical handle. Further, as may be desired, the fulcrum may be provided with a flat rear end provided below the handle to enable the user to assist the initial insertion step by applying a hammering force. In this latter event, the structure of the fulcrum may require a stronger material.

As assembled, the three components make up a pry bar configuration that is designed with a wider range of prying motions and amplified prying forces due at least in part to the strategic size and location of the fulcrum. Where added leverage is desired, the handle can be replaced with a longer handle. Where a different bar end tip is desired, the bar end can be replaced with a substitute bar end of desired end tip configuration.

With e.g. three handle lengths and e.g. four or more bar end types, a great latitude in pry bar tasks can be accommodated. Still further, the use can be expanded with different sizes of fulcrums to enable the configuration of even a greater variety of pry bar configurations.

The invention will be more fully appreciated upon reference to the following detailed description and drawings.

DETAILED DESCRIPTION

Figure 1:
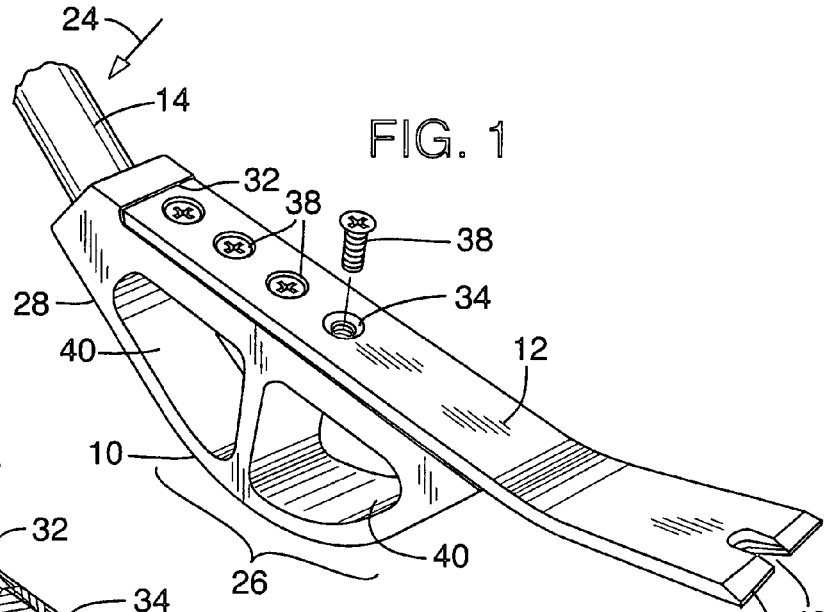
FIG. 1 illustrates in perspective a pry bar assembly in accordance with the invention.
Figure 2:
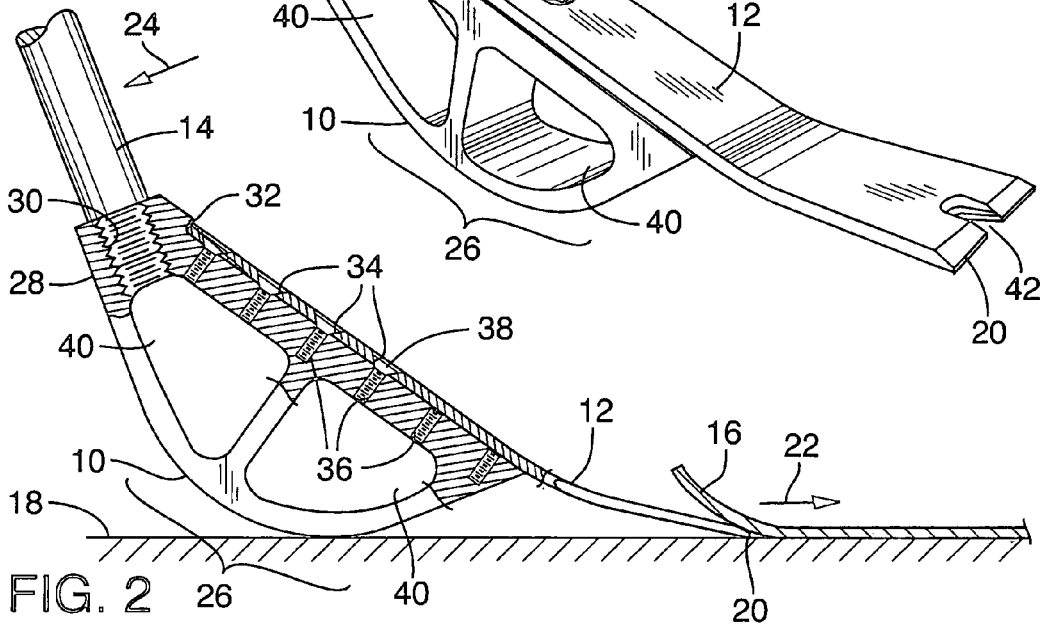
FIG. 2 is a side view of the pry bar of FIG. 1, partially in section, and shown in use for prying e.g. a board from a sub-flooring.

FIGS. 1 and 2 illustrate a pry bar of the present invention which includes a fulcrum 10, a bar end 12 and a handle 14. As illustrated in FIG. 2, the pry bar is being used to pry loose a board 16 secured as by nailing, gluing, etc. to a sub-flooring 18. As is typical for such use, the tool user first places the sharpened end tip 20 of the bar end 12 at the juncture between board 16 and sub-flooring 18. The tool is initially shoved under the edge of the board (arrow 22) as permitted by the tightness of the board to the sub-flooring. The handle is then forced down (arrow 24) which typically pries the board edge up enough to insert the bar further under the board (again, arrow 22) followed by substantial raising and loosening of the board 16 from the sub-flooring. It will be noted that the projected tip of the bar end is angled relative to the main body portion to present a flat orientation of the tip for this insertion procedure.

The above is an example only of but one type of use for the tool/pry bar. The tool is usable in many different ways and many different orientations. For example, it may be used to strip ceiling tiles from overhead, pry up heavy beams to permit a fork lift to slide under, or roll a large cylinder out of the way. The uses of such a pry bar are endless and the criteria is that the bar end, fulcrum and handle are arranged to enable the bar end tip to fit under the object to be pried, the fulcrum contact point positioned sufficiently close and in contact with a support, the bar end configured so as to enable the bar end tip to slide under the object, and with the handle sufficiently extended from the fulcrum to allow the user to apply a desired force to enable the user's leveraged force (arrow 24) to achieve raising of the object. Hereafter, such uses of such a pry bar is referred to as pry bar tasks.

As generally explained above, there are substantial variables depending on the use to be made of the tool. For "lighter" tasks, a lighter, more compact pry bar utilizing the shorter handle will be desired. For heavier tasks, a pry bar having a longer handle which provides greater leverage will be desired. When working overhead or prying off of the floor, i.e. removing tiles, a longer reach and thus longer handle may be desired, etc.

To accommodate these task variables, the present invention enables conversion from a short handle to a longer handle and/or conversion from a narrow bar end tip to a wider bar end tip and/or conversion to a different bar end type. Still further, the bar end can be shifted relative to the fulcrum, thus enabling deeper penetration under the object to be pryed.

Figure 3:
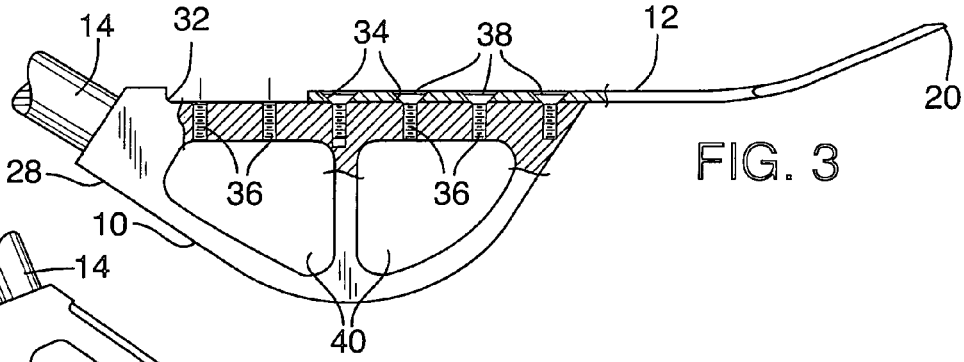
FIG. 3 illustrates the tool of FIG. 2 in an alternate state of assembly.

FIGS. 2–9 illustrate a conversion process of a preferred embodiment of the invention. As shown in FIGS. 2 and 3, the fulcrum component 10 has a curved bottom 26 that serves as the pivotal or engagement surface of the tool (see FIG. 2 where engagement with sub-flooring 18 is indicated). A rear end 28 has a threaded opening 30 for receiving a tubular handle 14. The upper side of the fulcrum has a notch 32 that is configured to receive various ones of the bar ends 12, 12', 12", 12'" (see FIGS. 7–9).

It will be noted from FIG. 2 that the notch configuration allows a lesser thickness underlying the bar end 12 while providing a greater wall thickness surrounding the opening 30. This accommodates the desire for lesser weight but without sacrificing strength where desired, e.g., surrounding the threaded opening 30. With reference to the bar ends 12, 12', etc. of FIGS. 5–9, they are provided with openings 34 that match up with the threaded holes 36 in the fulcrum 10. As will be observed with reference to FIGS. 2, 3, 5 and 6 there may be more threaded holes 36 than the number of openings 34 provided in the bar end 12, i.e. four holding screws 38 may be adequate for holding the bar end 12 but the greater number of threaded holes 36 allows the same bar end to be shifted outwardly as indicated in FIG. 3, i.e. the openings 34 are matched up with the outer-most threaded openings 36.

Figure 2A:
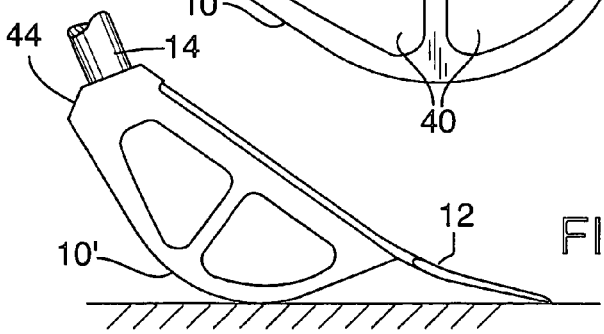
FIG. 2A illustrates a modification that enables hammering of the fulcrum.
Figure 4:
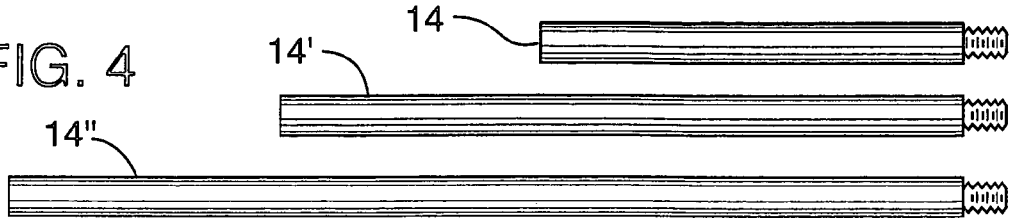
FIG. 4 shows a variety of handles for use with the tool of FIGS. 1–3.
Figure 5:
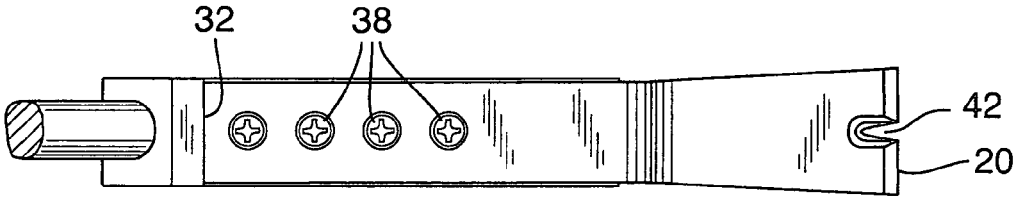
FIGS. 5 and 6 are top views of the tools as shown in FIGS. 2 and 3.

Whereas with all hand tools weight is a consideration, it is preferred that the fulcrum 10 be composed of a strong but light-weight metal e.g. aluminum, with further lightening of the weight provided by the openings 40. Should the tool be intended for hammering, i.e., striking a flat surface 44 in the alternate fulcrum structure 10' of FIG. 2A, it may be desired to thicken the web sections or make the fulcrum from a stronger material.

Many advantages are provided by a tool assembly as illustrated. A composite of handle, fulcrum and bar end is lighter than traditional pry bars and therefore easier to handle. It is more versatile in the tasks it can perform i.e. with rapid re-assembly options, and can adapt to many different uses. Among them is the ability to use a short handled pry bar when desirable and quickly connect to a longer handle when a longer reach for greater leverage is desirable.

The half moon shaped fulcrum provides a greater range of motion of the handle (arrow 24) which conveys a greater movement to the bar end 20 (compare FIGS. 2 and 3.) The ability to swap out or move the bar end on the fulcrum enables the pry bar to be set up for close in, more rapid removal tasks e.g. for the lighter tasks, but also enabling a set up for greater applied force for the heavier tasks. The simplicity of the assembly and re-assembly enables the user to accommodate multiple tasks with greater efficiency.

The pry bar, when fully assembled with a smaller handle, can fit into the same tool loops as designed for hammers and the like. The tool is easier to maneuver when standing on a ladder and because the handles are rapidly interchangeable, a user can adapt a tool to accommodate many different situations, e.g. to avoid having to stoop over when one can stand with a longer handle, or use a shorter handle to fit into tight spaces, etc.

In general, the pry bar tool can be easily and quickly replaced with a different pry bar end/or handle, creating a multi-usable tool for such varied work tasks as removal of cement, roof tiles, linoleum, plywood, beams, etc. Again, the variables are endless. For example note the provision of the crevice 42 on the bar ends 12 for pulling nails, staples, etc.

Whereas the above explanation illustrates a number of variables, many additional variables will become apparent to those skilled in the art. Accordingly, the claims are intended to encompass all such variables and the terms used are to be given their common understanding and meaning.

What is claimed is:

1. A pry bar tool assembly for performing pry bar tasks comprising:

a fulcrum, at least two bar ends having differing bar end tips for different pry bar usage and at least two handles of different lengths, said fulcrum configured to have a curved pivotal bottom surface, a flat top portion having a front end, and said fulcrum having a rear end;

said handles each releasably and replaceable connectable at one end of said handles to the rear end of the fulcrum and extended rearwardly from said rear end at different lengths from said rear end for different pry bar leverage, and each bar end having a connection opposite said bar end tips releasably and replaceably connectable to the flat top portion and extended forward of the front end of said fulcrum whereby said at least two bar ends and said at least two handles can be selectively assembled and reassembled to said fulcrum to provide at least four pry bar tool configurations.

2. A pry bar tool assembly as defined in claim 1 wherein the fulcrum flat top portion has a series of threaded screw/bolt receiving holes aligned lengthwise between the rear and front ends and said bar ends having a series of screw/bolt receiving openings that are matable with certain of the threaded screw/bolt receiving holes of the fulcrum for selective insertion of screws/bolts and thereby securement of either bar end to the fulcrum top for extension from the fulcrum front end.

3. A pry bar tool assembly as defined in claim 2 wherein at least one of the bar ends can be projected from the front end of the fulcrum at different lengths by the discriminate selection of different screw/bolt receiving openings mated with the bar end screw/bolt receiving openings.

4. A pry bar tool assembly as defied in claim 1 wherein the handles have an outer threaded cylindrical surface end portion with exterior screw threads thereon and said fulcrum rear end has a mated interior cylindrical opening threaded to receive said threaded outer cylindrical surface end portions of said handles.

5. A pry bar tool assembly as defined in claim 3 wherein the handles have an outer threaded cylindrical surface end portion with exterior screw reads thereon and said fulcrum rear end has a mated interior cylindrical opening threaded to receive said threaded outer cylindrical surface end portions of said handles.

6. A pry bar tool assembly as defined in claim 1 wherein at least one of said bar ends, when secured to said fulcrum, has a bar end tip with a sharpened flat end portion, said opened flat end portion discriminately angled whereby with the pivotal bottom of the fulcrum supported on a planar support surface and the bar end flat end portion engaged with the same support surface said flat end portion is extended substantially parallel to the plane of the support surface for insertion under an item lying on the support surface.

7. A system for customization of a pry bar to different prior bar tasks in construction and/or demolition, which system comprises:

a fulcrum, handle and a bar end having a bar end tip, and assembled together to provide beneficial properties applicable to the perforce of a prying task, one of said handle and bar end being removable and replaceable with an alternate handle of a different length for different pry bar leverage or bar end having a different bar end tip and as alternately assembled, providing different beneficial properties applicable to perform a different pry bar task.

8. A system as defined in claim 7 wherein said handle is removable and replaceable with a handle of a different length and providing the beneficial property of different leverage advantages to the user.

9. A system as defined in claim 7 wherein said bar end is removable and replaceable with a bar end of a different bar end tip, said bar end tip of said bar ends configured to beneficially perform different pry bar tasks.

10. A system as defined in claim 7 wherein said handle and said bar end are both removable and replaceable to selectively provide multiple combinations of pry bar types for performance of multiple pry bar tasks.

* * * * *

UNITED STATES PATENT AND TRADEMARK OFFICE

CERTIFICATE OF CORRECTION

Figure 6:
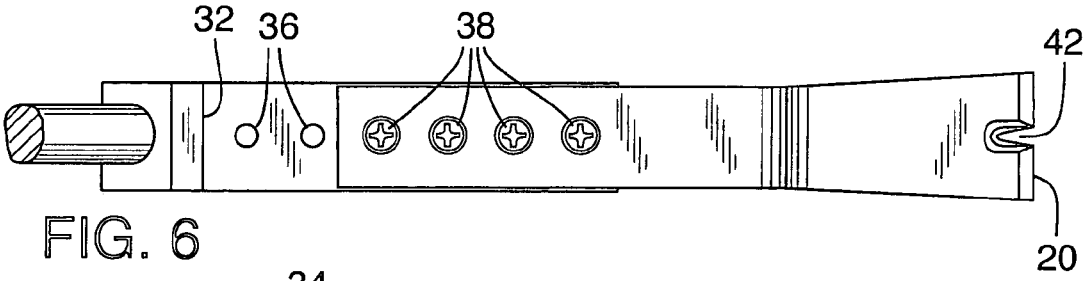

PATENT NO. : 6,913,246 B1
APPLICATION NO. : 10/777278
DATED : July 5, 2005
INVENTOR(S) : Skach It is certified that error appears in the above-identified patent and that said Letters Patent is hereby corrected as shown below:

Figure 6
Reference numeral 12 should be applied to the bar end.

Figure 7:
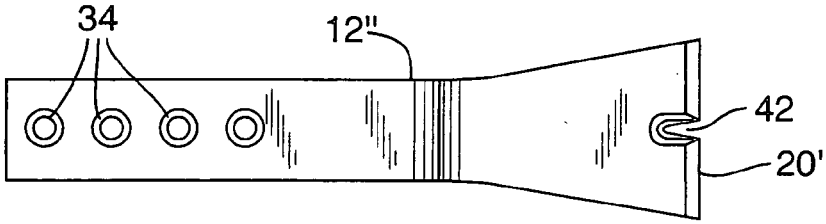
FIGS. 7–9 illustrate different bar ends for the tools of FIGS. 1–3.
Figure 8:
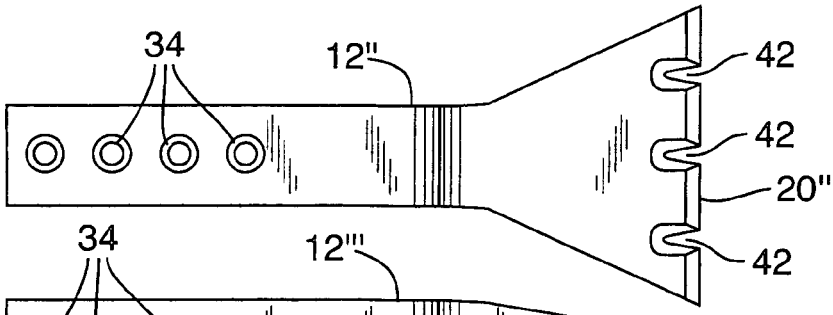
Figure 9:
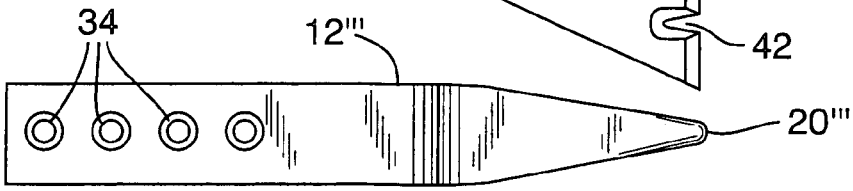

Figure 7
Reference numeral " 12" " should read --12'--.

Column 3
Line 37, "...outer-most..." should read --...outermost…--.
Line 58, "...bar end 20..." should read --...end tip 20..--.

Column 4
Line 25, "...replaceable connectable..." should read --...replaceably connectable…--.
Line 58, "...screw reads..." should read --...screw threads…--.
Line 65, "...opened flat end..." should read --...sharpened flat end…--.

Column 5
Line 1, "...surface said flat end..." should read --...surface, said flat end…--.
Line 9, "...the perforce of..." should read --...the performance of…--.

Signed and Sealed this

Twenty-first Day of August, 2007

JON W. DUDAS
*Director of the United States Patent and Trademark Office*